US010544661B2

(12) United States Patent
Noui-Mehidi et al.

(10) Patent No.: US 10,544,661 B2
(45) **Date of Patent: *Jan. 28, 2020**

(54) APPARATUS AND METHODS FOR ENHANCED WELL CONTROL IN SLIM COMPLETIONS

(71) Applicant: Saudi Arabian Oil Company, Dhahran (SA)

(72) Inventors: Mohamed N. Noui-Mehidi, Dhahran (SA); Jinjiang Xiao, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 279 days.

This patent is subject to a terminal disclaimer.

(21) Appl. No.: 14/274,359

(22) Filed: May 9, 2014

(65) Prior Publication Data

US 2014/0246204 A1 Sep. 4, 2014

Related U.S. Application Data

(63) Continuation of application No. 12/962,387, filed on Dec. 7, 2010, now Pat. No. 8,727,016.

(51) Int. Cl.
*E21B 43/12* (2006.01)

(52) U.S. Cl.
CPC ..... *E21B 43/128* (2013.01)

(58) Field of Classification Search
CPC ..... E21B 43/128
See application file for complete search history.

(56) References Cited

U.S. PATENT DOCUMENTS 3,670,832 A 6/1972 Striegler
3,672,795 A * 6/1972 Arutunoff et al. .... E21B 43/128 415/901
4,440,221 A * 4/1984 Taylor ..... E21B 33/1294 166/106

(Continued)

FOREIGN PATENT DOCUMENTS

FR 2840952 A1 12/2003

OTHER PUBLICATIONS

Written Opinion of the International Preliminary Examining Authority issued in related PCT Patent Application No. PCT/US2011/063642; dated Aug. 7, 2013; 8 pages.
Walter Dinkins et al., "Thru-Tubing Conveyed ESP Pump Replacement—Live Well Intervention," SPE 116822, SPE Annual Technical Conference and Exhibition; Jan. 1, 2008; 15 pages.

(Continued)

*Primary Examiner* — D. Andrews
(74) *Attorney, Agent, or Firm* — Bracewell LLP; Constance G. Rhebergen; Linda L. Morgan

(57) ABSTRACT

A system to enhance well control in slim completions in an oil well includes an electrical submersible pump ("ESP") positioned within a casing and having at least a portion thereof extending outwardly from a production tubing positioned within the casing. The production tubing terminates adjacent a distal end portion of a pump discharge to thereby provide greater interstitial space between outer surfaces of the portion of the pump disposed to extend outwardly from the production tubing and inner walls of the casing. This increased interstitial space, for example, can assist in cost savings by reducing the rate of erosion damage to the ESP. Embodiments of the present invention can further include a valve connected to inner walls of the casing and positioned distal from the ESP to control the flow of hydrocarbons.

13 Claims, 5 Drawing Sheets

(56) References Cited

U.S. PATENT DOCUMENTS

| | | | | |
|---|---|---|---|---|
| 4,901,069 | A | 2/1990 | Veneruso | |
| 5,173,022 | A | 12/1992 | Sango | |
| 5,176,164 | A | 1/1993 | Boyle | |
| 5,554,897 | A | 9/1996 | Martin et al. | |
| 5,662,167 | A | 9/1997 | Patterson et al. | |
| 6,167,965 | B1 * | 1/2001 | Bearden | E21B 43/121 166/105.5 |
| 6,364,013 | B1 | 4/2002 | Watson et al. | |
| 6,494,267 | B2 | 12/2002 | Allen | |
| 6,598,675 | B2 | 7/2003 | Bussear et al. | |
| 6,668,925 | B2 | 12/2003 | Shaw et al. | |
| 6,768,700 | B2 | 7/2004 | Veneruso et al. | |
| 7,073,594 | B2 | 7/2006 | Stegemeier et al. | |
| 7,188,669 | B2 | 3/2007 | Bullock et al. | |
| 7,311,152 | B2 | 12/2007 | Howard et al. | |
| 7,487,838 | B2 | 2/2009 | Knight et al. | |
| 7,635,030 | B2 | 12/2009 | Knight et al. | |
| 7,677,320 | B2 | 3/2010 | Shaw et al. | |
| 7,703,508 | B2 | 4/2010 | Orban | |
| 7,753,115 | B2 * | 7/2010 | Zupanick | E21B 33/128 166/106 |
| 2002/0050361 | A1 | 5/2002 | Shaw et al. | |
| 2002/0114216 | A1 * | 8/2002 | Veneruso | E21B 47/12 367/83 |
| 2005/0217843 | A1 | 10/2005 | Rezui et al. | |
| 2010/0025045 | A1 | 2/2010 | Lake et al. | |
| 2010/0206577 | A1 | 8/2010 | Martinez | |

OTHER PUBLICATIONS

John Patterson et al., "First 4.5-in Through-Tubing ESP with Downhole Wet Connect," SPE 123996, Proceedings of SPE Annual Technical Conference and Exhibition; Jan. 1, 2009; 13 pages.

International Search Report with Written Opinion issued in related PCT Patent Application No. PCT/US2011/063642; dated Sep. 19, 2012; 15 pages.

"Expro's wireless safety valve system provides alternative to workovers/ Drilling Contractor," Drilling Contractor Magazine; May 2010; 2 pages.

Khalifah M. Al-Amri et al., "Case-History—World's First Slim Open Hole Smart MRC Wells," SPE 117050; Society of Petroleum Engineers; Mar. 2009; 6 pages.

Clark E. Robinson, "Monobore Completions for Slim-Hole Wells," SPE 29217; Society of Petroleum Engineers; Jun. 1994; pp. 794-799.

P.D. Howlett et al., "Case Study of New Slender Well Construction Technology," SPE 102580; Society of Petroleum Engineers; Sep. 2006; 12 pages.

Hisham A. Mubarak et al., "ESP Failures/Analysis/Solutions in Divided Zone—Case Study," SPE 81488; Society of Petroleum Engineers; Apr. 2003; 6 pages.

J.R. Lea et al., "Artificial Lift for Slim Holes," SPE 63042; Society of Petroleum Engineers; Oct. 2000, 9 pages.

Jim Albright et al., "Road Map for a 5000-FT Microborehole," 43 pages.

* cited by examiner 10
73
72
71
24
22
32
26
38
36
30
34
35
39
21
52
20
54
60
28

APPARATUS AND METHODS FOR ENHANCED WELL CONTROL IN SLIM COMPLETIONS

FIELD OF THE INVENTION

Embodiments of the present invention relate generally to well control of hydrocarbon wells. More particularly, embodiments of the present invention relate to well control of a slim hole well.

BACKGROUND

Reliable well control is essential in many industries, particularly in the oil and gas industry. In many cases, electrical submersible pumps ("ESPs") are used to artificially lift a product stream of hydrocarbons. Well control is especially problematic in slim completions because of space restrictions. Slim completions are generally defined as a completion where the inside diameter of the well is smaller than conventional, (e.g., less than seven (7) inches). Space restrictions often cause high flow velocities that lead to serious erosion problems and friction losses. Moreover, erosion damage to an ESP causes premature failures of the ESP and loss of production.

In many conventional slim completions, the tubing extends along the inner walls of the casing and beyond the most down hole portion of the ESP. Additionally, a subsurface safety valve is often connected to the inner walls of the tubing to prevent hydrocarbons from reaching the surface in case of an emergency. In the alternative, or in addition to the subsurface safety valve, a control valve is connected to the inner walls of the tubing to control the flow of hydrocarbons that are pumped to the surface. During operation, hydrocarbons are pumped by the ESP from the interstitial space between the outer wall of the pump and the inner walls of the tubing.

SUMMARY OF THE INVENTION

Applicant has recognized that this conventional slim completion arrangement, however, can restrict the flow rates of hydrocarbons lifted by the ESP. Moreover, in a standard slim completion, spatial restrictions can lead to premature erosion damage to the ESP due to the high velocity in the long narrow gap between the outer surfaces of the ESP and the inner walls of the tubing. This ultimately, for example, can cause costly premature ESP failure and lost of production. Accordingly, a need exists for enhanced well control in slim completion where a high production flow rate is demanded. Applicants have recognized a need for enhanced well control in slim completion.

In view of the foregoing, embodiments of apparatus and methods according to the present invention can assist in reducing the risk of erosion damage to an electric submersible pump ("ESP") operable to pump hydrocarbons from a slim hole well to the surface. Embodiments of the present invention also can assist in minimizing friction loss of hydrocarbons pumped by the ESP.

Embodiments of the present invention can include an ESP positioned within a casing so that at least a portion of the ESP is disposed to extend outwardly from production tubing to thereby provide greater interstitial space between outer surfaces of the portion of the ESP disposed to extend outwardly from the production tubing and the inner walls the casing in a location where hydrocarbons are lifted therefrom. According to embodiments of the present invention, the production tubing can terminate adjacent a distal end portion of a pump discharge so that at least a portion of the ESP is disposed to extend outwardly from a distal end portion of the production tubing. By ending the production tubing adjacent the distal end portion of the pump discharge, interstitial space in a location where hydrocarbons are pumped is increased to thereby assist in reducing friction loss and risk of premature erosion damage to the ESP. This arrangement and positioning, for example, also can allow hydrocarbons to more readily flow between inner walls of the casing and outer surfaces of the ESP when pumped by the ESP.

Embodiments of the present invention further can include, for example, a subsurface prevention valve connected to inner walls of the casing and positioned down hole from the ESP to prevent hydrocarbons from entering the interstitial space between the outer walls of the portion of the ESP disposed to extend outwardly from the production tubing and inner walls of the casing. In the alternative to or in addition to the subsurface prevention valve, embodiments of the present invention can include, for example, an electric inflow control valve connected to the inner walls of the casing. The electric inflow control valve, according an embodiment of the present invention, is positioned down hole from the ESP to control the flow of hydrocarbons that enter the interstitial space between the outer walls of the portion of the ESP disposed to extend outwardly from distal end portions of the production tubing and inner walls of the casing in a location where hydrocarbons are pumped therefrom.

An ESP, according to embodiments of the present invention, can receive power and communication by wired or wireless modes. For example, an embodiment of the present invention can include an ESP, as understood by those skilled in the art, with an inductive coupler to provide electromagnetic power and wireless communication to the subsurface prevention valve. According to another embodiment of the present invention, the ESP can include, for example, an electronic extension connected to the pump to provide electromagnetic power and wireless communication to the electric inflow control valve. Yet another embodiment of the present invention can include, for example, an electric wet connection cable as understood by those skilled in the art connected to the ESP and the subsurface prevention valve to provide power and communication to the subsurface prevention valve. The electric wet connection cable can also provide power and communication to the electric inflow control valve. Embodiments of the present invention can include, as understood by those skilled in the art, wireless communication and electromagnetic power transfer as a primary mode, and wired communication and power transfer as a secondary, fall-back mode. Alternatively, embodiments of the present invention can include, as understood by these skilled in the art, wired communication and power transfer as a primary mode and wireless communication and electromagnetic power transfer as a secondary, fall-back mode.

According to an embodiment of the present invention, the ESP can include, for example, a motor for driving the pump, one or more seat sections to prevent hydrocarbons from entering inner surfaces of the motor, and a pump intake positioned in a location where hydrocarbons enter the ESP. The ESP can further include, for example, a medial pump body portion having one or more centrifugal pumps and positioned to pump hydrocarbons that enter through the pump intake. The pumped hydrocarbons, for example, can be discharged through a pump discharge positioned within the production tubing so that the hydrocarbons are discharged to a proximal region within the inner walls of the production tubing and onward to the surface.

Embodiments of the present invention also include methods of enhanced well control in slim completions. Embodiments of a method can include providing or operating any of the apparatus embodiments according to the present invention. For example, an embodiment of a method of enhanced well control in slim completion includes positioning casing into a slim bore of a hydrocarbon well extending inwardly from a surface and having a slim completion. The method further includes positioning production tubing partially within the casing to provide a pathway for hydrocarbons dispersed from the well. According to an embodiment of the present invention, the method includes positioning an ESP within the casing through the production tubing with an electric cable so that at least a portion of the ESP extends outwardly from the production tubing within the casing.

According to embodiments of the methods, the positioning of the ESP should be so that the outer diameter of the ESP is smaller than the inner diameter of the production tubing to thereby provide greater interstitial space between the outer surface of the portion of the ESP disposed to extend outwardly from distal end portions of the production tubing and the inner walls of the casing when the portion of the ESP extends outwardly from the production tubing, e.g., further down hole. The method can farther include, for example, directing hydrocarbons into the interstitial space between outer surfaces of the portion of the ESP disposed to extend outwardly from the production tubing and the inner walls of the casing, and operating the ESP so that the hydrocarbons from the interstitial space enter the ESP, flow through the ESP, and discharge from the ESP to a proximal region within the inner walls of the production tubing and onward to the surface.

BRIEF DESCRIPTION OF THE DRAWINGS

So that the manner in which the features and advantages of the present invention, as well as others which will become apparent are attained and can be understood in more detail, a more particular description of the present invention briefly summarized above may be had by reference to the embodiments thereof which are illustrated in the appended drawings, which drawings form a part of this specification. It is to be noted, however, that the drawings illustrate only embodiments of the present invention and, therefore, are not to be considered limiting of its scope as the present invention may admit to other equally effective embodiments.

DETAILED DESCRIPTION

Embodiments of the present invention will now be described more fully hereinafter with reference to the accompanying drawings, which illustrate embodiments of the present invention. This invention may, however, be embodied in many different forms and should not be construed as limited to the illustrated embodiments set forth herein; rather, these embodiments are provided so that this disclosure will be thorough and complete, and will fully convey the scope of the present invention to those skilled in the art. Like numbers refer to like elements throughout.

Embodiments of the present invention can enhance well control in slim completions and assist in reducing risk of premature erosion damage to an electrical submersible pump ("ESP") 30. As will be understood by those skilled in the art, embodiments of the present invention, for example, also can allow hydrocarbons to more readily flow when pumped by use of the ESP 30. Embodiments of the present invention, for example, pump hydrocarbons from a slim bore of a horizontal or vertical hydrocarbon well 10 to the surface thereof. The slim bore of the well, for example, and as understood by those skilled in the art, can have an inside diameter D1 in the range of about two (2) to seven (7) inches so that the slim bore and associated casing 20 define a "slim completion."

Because the diameter of slim completions are less than conventional bore diameters, the construction cost of a well can be less than those associated with conventional completions. For example, the smaller diameter of a slim completion can result in reducing the amount of construction materials such as cement, mud and tubular components necessary to complete a slim completion. Although slim completions can result in savings in construction cost, production rates can be problematic because of the restricted space. The restricted space also can result in premature failure of down hole components such as an ESP due to erosion damage. Accordingly, embodiments of the present invention can enhance well control, for example, by improving production rates and reducing the rate of premature failure of an ESP.

Figure 1:
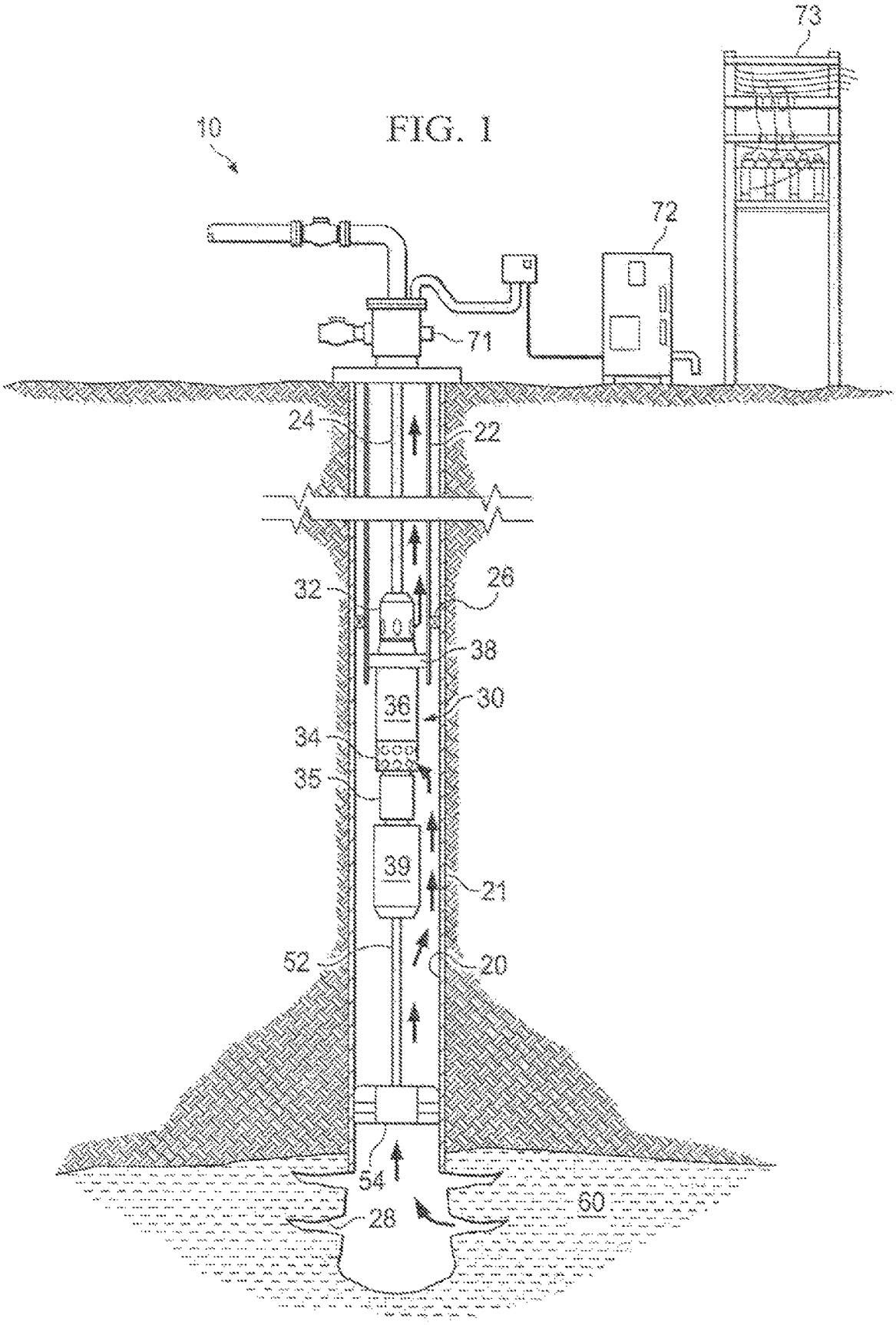
FIG. 1 is an environmental view of an apparatus for enhancing well control in slim well completions according to an embodiment of the present invention.
Figure 4:
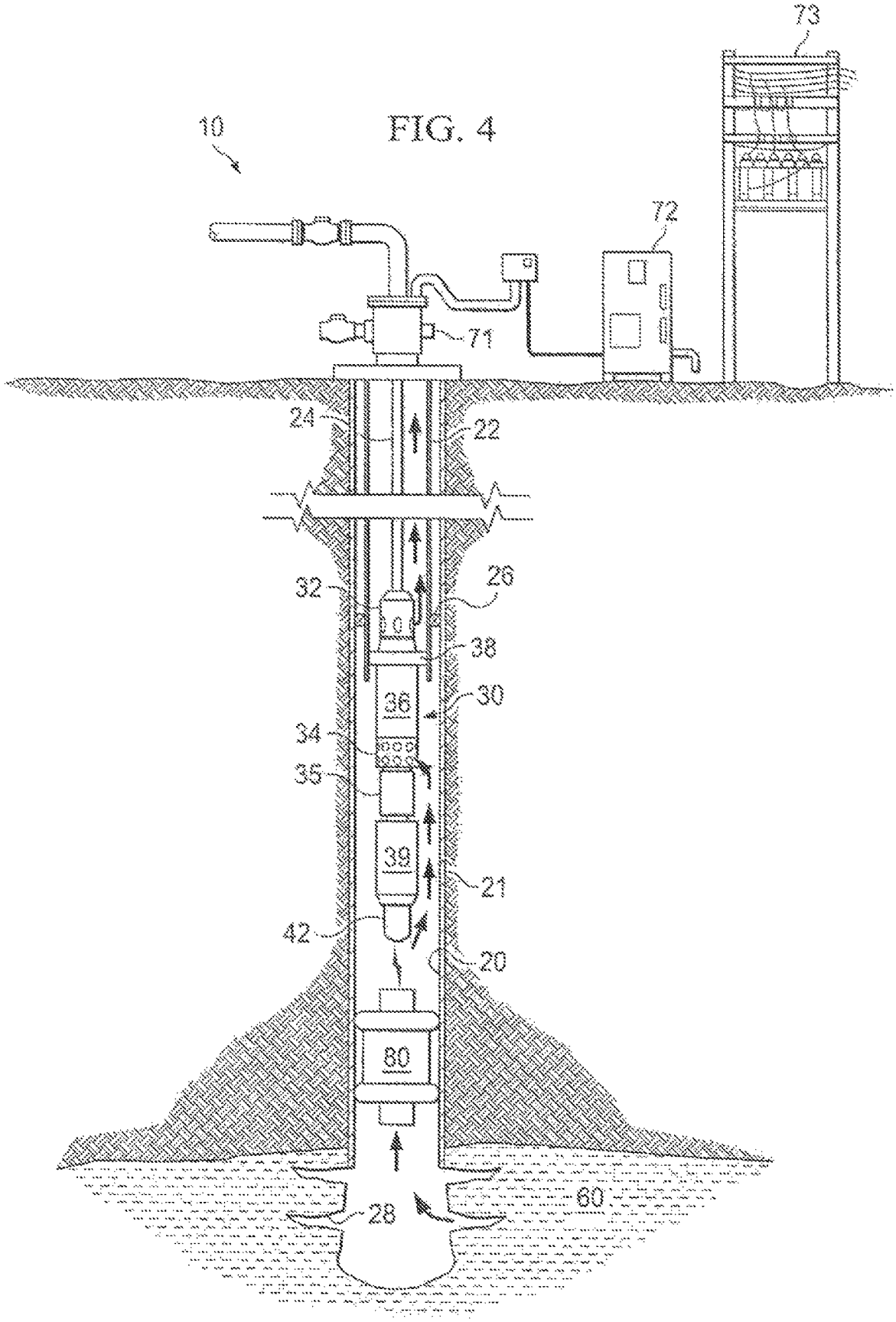
FIG. 4 is an environmental view of an apparatus for enhancing well control in slim well completions according to another embodiment of the present invention.

Embodiments of the present invention include positioning casing 20 within the slim bore of the well. The casing 20 has an inside diameter D2 that the major down hole components are positioned within. The bottom of the well can be an open-hole, cased-hole completion, or any other bottom hole completion, as will be understood by those skilled in the art, to be suitable for embodiments of the present invention. For example, an open-hole, top set, or barefoot completion can be made by drilling down to a proximal end of the producing formation 60 and subsequently casing the well. According to this embodiment, the well is drilled through the producing formation 60 leaving the bottom of the well open. The casing 20 in a cased-hole completion, according to another embodiment of the present invention, is run through the production formation 60, and cemented in place. As illustrated in FIGS. 1 and 4, according to this embodiment, perforations 28 are made in the casing 20 to allow hydrocarbons to fluidly travel within the casing 20 and onward to the surface.

According to embodiments of the present invention, after the casing 20 is positioned within the well, cement is pushed between the outer walls of the casing 21 and the inner walls of the slim bore to connect and support the casing 20 thereto. The casing 20, for example, can prevent the contamination of fresh water zones. The casino 20 can be made out of steel pipe to support the slim bore of the well, and according to the American Petroleum Institute specifications and standards as understood by those skilled in the art.

To further support the bore of the well and to provide a pathway for hydrocarbons dispersed from the well 10 to the surface, embodiments of the present invention include production tubing 22. As will be understood by those skilled in the art, the production tubing 22 preferably is positioned only partially within the casing 20 to thereby provide greater interstitial space (e.g., annular space) in a location where hydrocarbons are pumped therefrom to the surface. The production tubing 22 has an outside diameter D3 that is less than the inside diameter of the casing D2. A packer 26 is positioned between outer walls of the tubing 22 and inner walls of the casing 20 (i.e., between the outside diameter of the tubing D3 and the inside diameter of the casing D2) to support the positioning of the tubing 22 within the casing 20. The packer 26 also prevents hydrocarbons from passing between an auxiliary interstitial space region 51 between outer walls of the production tubing and inner walk of the casing proximal from the packer 26.

Figure 2:
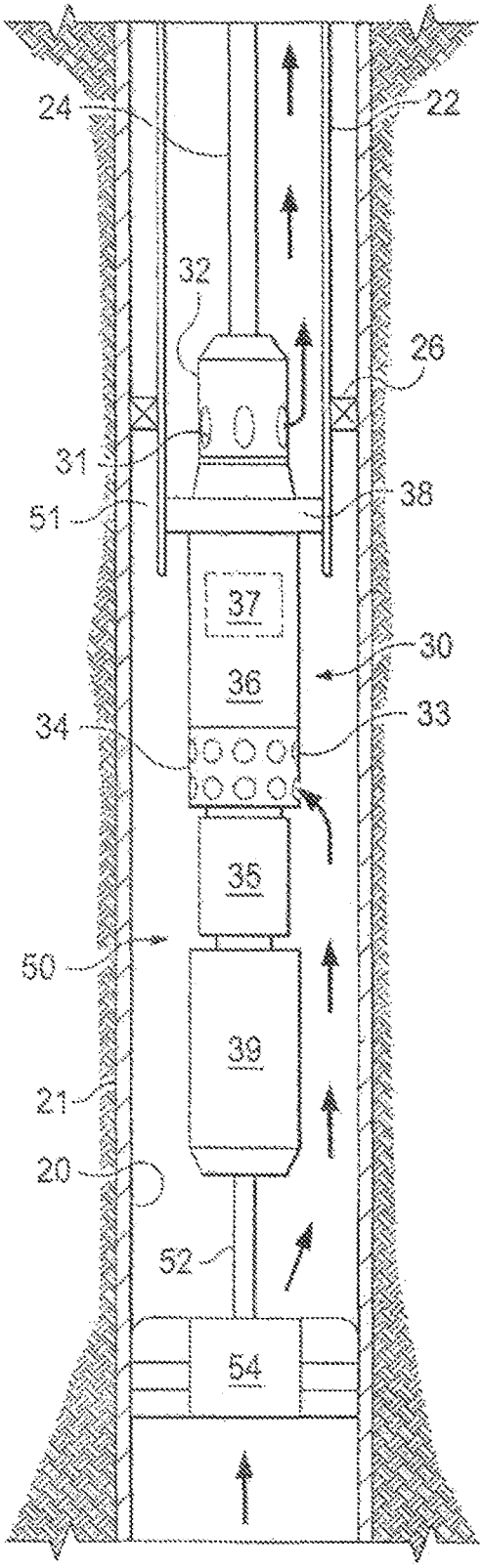
FIG. 2 is an enlarged front elevational view of FIG. 1 according to an embodiment of the present invention.
Figure 5:
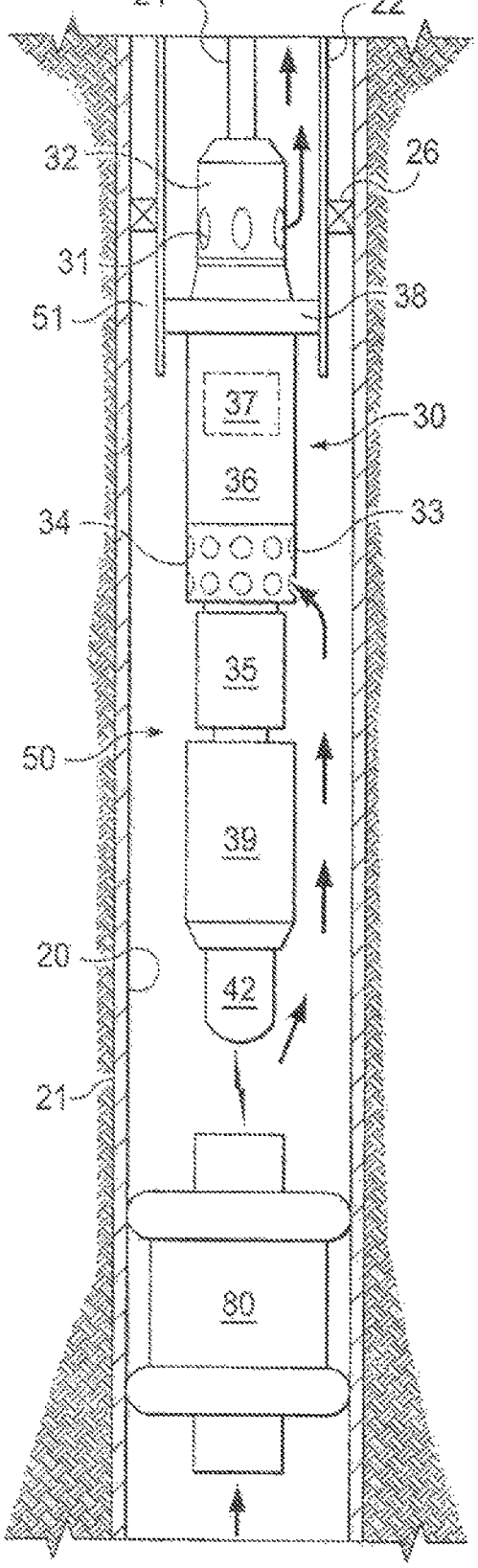
FIG. 5 is an enlarged front elevational view of FIG. 4 according to an embodiment of the present invention.

As illustrated in FIGS. 2 and 5, embodiments of the present invention include an ESP 30 being operable to pump hydrocarbons from the well 10 and thereby fluidly travel to the surface. The ESP 30 is positioned within the casing 20 so that at least a portion of the ESP extends outwardly from the production tubing 22. This portion of the ESP is disposed to extend outwardly from the production tubing 22, e.g., further down hole, within the casing 20 and can include, for example, the motor 39, one or more seal sections 35, a pump intake 34, and at least a region of a medial pump body portion 36 in such an embodiment. The outer diameter of the ESP 30, according to an embodiment of the present invention, has a smaller diameter than the inside diameter of the production tubing D4 to thereby provide an interstitial space 50 between outer suffices of the portion of the ESP disposed to extend outwardly from distal end portions of the production tubing 22 within the casing 20 and the inner walls of the casing 20.

Figure 3:
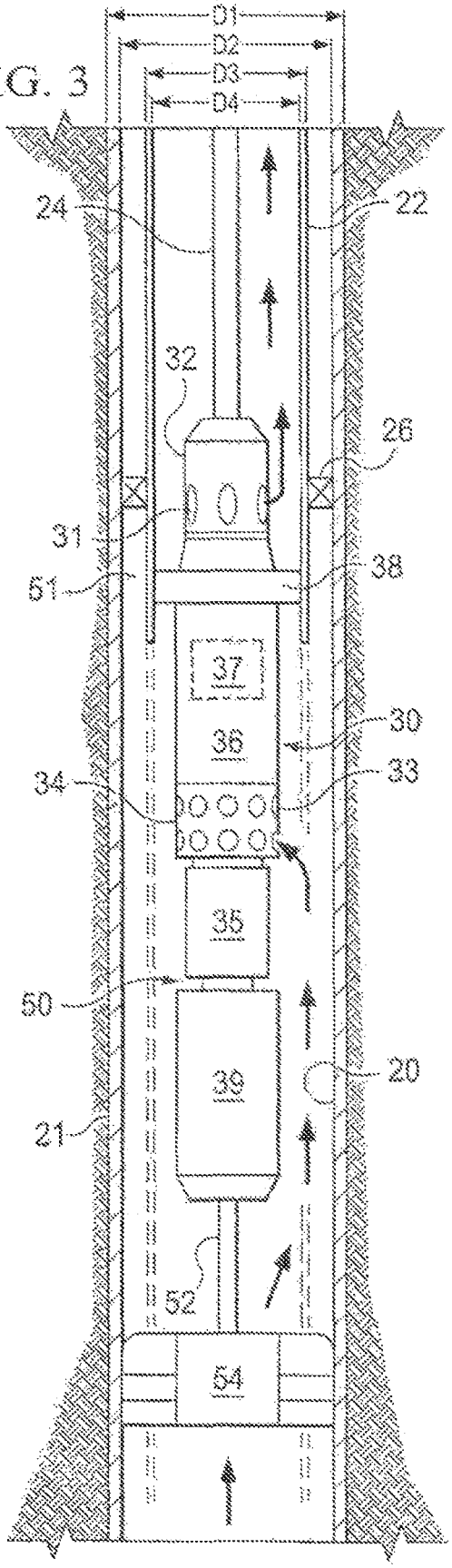
FIG. 3 is an enlarged front elevational view of FIG. 1 illustrating increased interstitial space in dashed lines according to an embodiment of the present invention.
Figure 6:
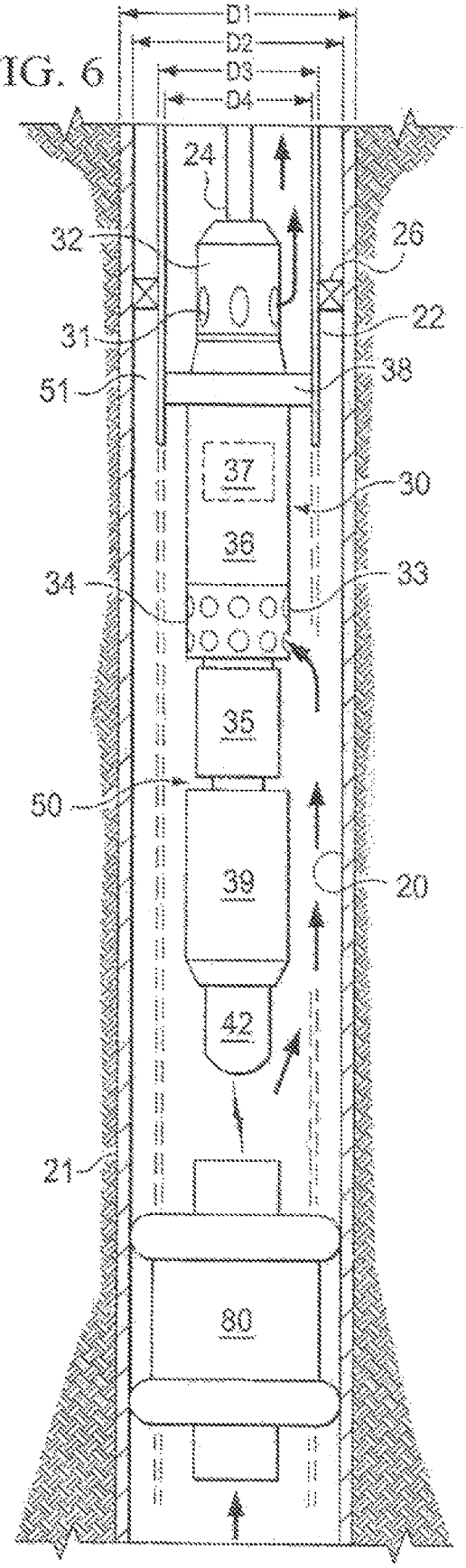
FIG. 6 is all enlarged elevational view of FIG. 4 illustrating increased interstitial space in dashed lines according to an embodiment of the present invention.

The positioning arrangement of the ESP 30 and the production tubing 22, as illustrated in FIGS. 3 and 6, provides a greater interstitial spaces 50 in a location where hydrocarbons are pumped therefrom than in a location where production tubing otherwise would extend beyond the most down hole portion of the ESP, such as in a standard slim completion. As will be understood by those skilled in the art, this positioning and arrangement also can allow hydrocarbons to more readily flow between the outer surfaces of the portion of the pump disposed to extend outwardly from the production tubing 22 and inner walls of the casing 20 in a location when hydrocarbons are pumped by the ESP 30. This increased interstitial space 50 also, or example, can increase production rates and decrease friction loss of pumped hydrocarbons.

As illustrated in FIGS. 1 and 4, to pump or transfer hydrocarbons to the surface for production, embodiments of the present invention transmit available surface power to the ESP 30 positioned down hole within the well 10. As understood by those skilled in the art, a transformer 73, for example, can be used to transform the available power (i.e., from surrounding power lines) for transmission for down hole power requirements of the well 10. The transformed power, for example, can be transmitted from the transformer 73 to a switchboard 72 that controls the variable speed of the ESP 30 and other operating parameters. The surface equipment, as will be understood by those skilled in the art, further can include, for example, a junction box 74 to provide a connection between the down hole electric cable 24 and the surface electric cable. The down hole electric cable can be, for example, the same cable as electric cable on the surface. Through the junction box 74, power then runs to a wellhead 71 that provides pressure control for the well 10. As will be understood by those skilled in the art, the power is transmitted from the wellhead 71 down hole to the ESP 30 to produce hydrocarbons from a producing formation 60 to the surface.

During operation, according to embodiments of the present invention, the motor 39 of the ESP receives power through the electric cable 24 to thereby drive the one or more centrifugal pumps 37 within a medial pump body portion 36 of the ESP. The one or more centrifugal pumps 37 suctions hydrocarbons from an interstitial space 50 between the outer surfaces of the portion of the ESP extending outwardly from the production tubing 22 and the inner walls of the casing 20. The hydrocarbons are suctioned from this interstitial space 50 through a plurality of intake slots 33, and pumped by the one or more centrifugal pumps 37 to increase the pressure and flow of the hydrocarbons that entered the pump intake 32. The hydrocarbons are then discharged through a plurality of discharge slots 31 to a proximal region within inner walls of the production tubing 22 and onward to the surface.

Embodiments of the ESP 30 include a motor 39 to drive one or more centrifugal pumps 37 within a medial pump body portion 36. The motor 39, for example, can be the most down hole major component of the ESP 30 and can be disposed to extend outwardly from distal end portions of the production tubing 22 within the casing 20. During operation, the motor 39 runs in the range of speed of about 2500 to 3500 rev/min. As will be understood by those skilled in the art, during operation, the flow of hydrocarbons that pass the outer surfaces of the motor also can act as a coolant to reduce heat associated with operation of the ESP to thereby assist in preventing the ESP 30 from overheating. Because the increased interstitial space 50, for example, can result in an increase flow of hydrocarbons, embodiments of the present invention can also reduce the risk of the motor 39 overheating as well.

Embodiments of the ESP 30 further include one or more seal sections 35 to prevent hydrocarbons from entering within inside surfaces of the motor 39. The one or more seal sections 35, in this embodiment, is positioned outside the production tubing 22 within the casing 20 and connected to a proximal end portion of the motor 39. In addition to preventing hydrocarbons from entering the inside surfaces of the motor, the one or more seal sections 35 equalizes external bottom hole pressures and internal pressures of the motor 39. Moreover, as will be understood by those skilled in the art, the one or more seal sections 35 allows lubricant associated with the motor to thermally expand and contract.

Embodiments of the ESP 30 also include a pump intake 34 whereby hydrocarbons enter the ESP 30. The pump intake 34 includes a plurality of intake slots 33 that are evenly spaced in a location where the hydrocarbons are suctioned therethrough. The plurality of intake slots 33 can be a variety of uniform shapes including, but not limited to, spherical, ellipsoidal, or rectangular as understood by those skilled in the art. The pump intake 34 preferably is positioned to extend outwardly from distal end portions of the production tubing 22 within the casing 20 and connected to extend between a proximal end portion of the one or more seal sections 35 and a distal end portion of the medial pump body portion 36 as illustrated.

The medial pump body portion 36, according to an embodiment of the ESP 30, includes one or more centrifugal pumps 37 to pump the hydrocarbons that enter the ESP 30. The horsepower of the one or more centrifugal piano 37 ranges from about 75 to 300 during operation. The one or more centrifugal pumps 37 increase the flow rate of the hydrocarbons that entered the ESP to artificially lift the hydrocarbons to the surface. In a preferred embodiment of an ESP 30, the one or more centrifugal pumps 37 have a large number of stages, each stage having an impeller and a diffuser. The medial pump body portion 36 extends between the pump intake 34 and a pump discharge 32 so that hydrocarbons flow therebetween from the pump intake 34 to the pump discharge 32. The medial pump body portion 36, for example, can extend, at least partially, outwardly from the production tubing 22 within the casing 20. Alternatively, the medial pump portion 36 can extend, for example, entirely outside the production tubing 22.

Embodiments of the present invention can also include a supporting member 38 disposed between the pump discharge 32 and the medial pump body portion 36. According to embodiments of the present invention, the supporting member 38 connects to the inner walls of the production tubing 22 to support the positioning of the ESP 30 so that the pump discharge 32 is positioned within the inner walls of the production tubing 22 proximal from the supporting member 38. The supporting member 38, as will be understood by those skilled in the art, also enables, for example, the pump intake 34 to be positioned outside the production tubing 22 within the casing 20 distal from the supporting member 38. The supporting member 38 can be, for example, adjacent an auxiliary interstitial space 51 between the inner walls of the casing 20 and the outer walls of the production tubing 22. The down hole end of the production tubing 22, for example, can terminate near the supporting member 38 distal from the packer 26. Terminating the production tubing 22 near the packer 26, for example, provides a greater major interstitial space 50 between the outer surfaces of the ESP disposed outside the production tubing and the inner surfaces of the casing 20.

Embodiments of the ESP 30 include the pump discharge 32 to discharge the pumped hydrocarbons for onward transfer within the production tubing to the surface. The pump discharge 32, for example in this embodiment, includes a plurality of discharge slots 31 that are evenly spaced in a location where the hydrocarbons are discharged to a proximal region within the inner walls of the production tubing 22. The plurality of discharge slots 31, as will be understood by those skilled in the art, can be a variety of uniform shapes including, but not limited to, spherical, ellipsoidal, or rectangular. As illustrated by the arrows in FIGS. 1 and 4, for example, the pump discharge 32 is positioned within the production tubing 22 so that pumped hydrocarbons discharge through the discharge slots 31 and fluidly travel through the production tubing 22 and onward to the surface. The down hole end of the production tubing 22, according to an embodiment of the present invention, for example, can terminate adjacent a distal end portion of the pump discharge 32 to provide a at interstitial space 50 between the outer surfaces of the ESP disposed to extend outwardly from the production tubing 22 and the inner surfaces of the casing 20.

Embodiments of the present invention also can include, for example, a subsurface prevention valve 54 being operable to prevent hydrocarbons from flowing into the interstitial space 50 between the outer surfaces of the portion of the ESP disposed outwardly from the production tubing 22 within the casing 20 and the inner walls of the casing 20. The subsurface prevention valve 54 selectively, or in the case of an emergency, assists to prevent hydrocarbons from dispersing to the surface. The subsurface prevention valve 54, according to embodiments of the present invention, is connected to the inner walls of the casing 20 and distally disposed from the ESP 30 within the slim completion. As will be understood by those skilled in the art, and as illustrated in FIG. 3, the arrangement and positioning of the subsurface prevention valve 54 distal from the ESP 30 provides a greater interstitial space 50 between the outer surfaces of the ESP and the inner walls of the casing 20 in a location where hydrocarbons are pumped therefrom. Moreover this arrangement and positioning of the subsurface prevention valve 54, as will be understood by those skilled in the art, assist in reducing the risk of erosion damage to the ESP 30, reduce friction loss of the hydrocarbons produced from the producing formation 60, and increase production rates from the slim completion.

During operation, as illustrated in FIG. 1, hydrocarbons are produced from the producing formation 60 and flow through the perforations 28 to the inner walls of the casing 20 distal from the subsurface prevention valve 54. According to an embodiment of the present invention, power and communication are transmitted to the subsurface prevention valve 54 through an electric wet connection cable 52 connected to a distal end portion of the ESP and a proximal end of the subsurface prevention valve 54. The electric wet connection cable 52 receives power from the electric cable 24 through the ESP 30. When the subsurface prevention valve 54 is in the "on" position, hydrocarbons flow through the inner surfaces of the subsurface prevention valve 54 to the interstitial space 50 between the outer surfaces of the portion of the pump disposed outside the producing tubing 22 within the casing and the inner walls of the casing 20 as illustrated. Moreover, hydrocarbons can be pumped from the auxiliary interstitial space 51 (e.g., annulus space) between the inner walls of the casing 20 and the outer walls of the production tubing distal from the packer 26. When the subsurface prevention valve 54 is in the "off" position, hydrocarbons are prevented from traveling to the interstitial space 50 between the outer surfaces of the portion of the pump disposed outside the production tubing within the casing and the inner walls of the casing 20. The subsurface prevention valve 54, as will be understood by those skilled in the art, preferably is in a fall-back mode so that any interruption or malfunction of the slim completion should result in the subsurface prevention valve 54 being in the off position.

Figure 7:
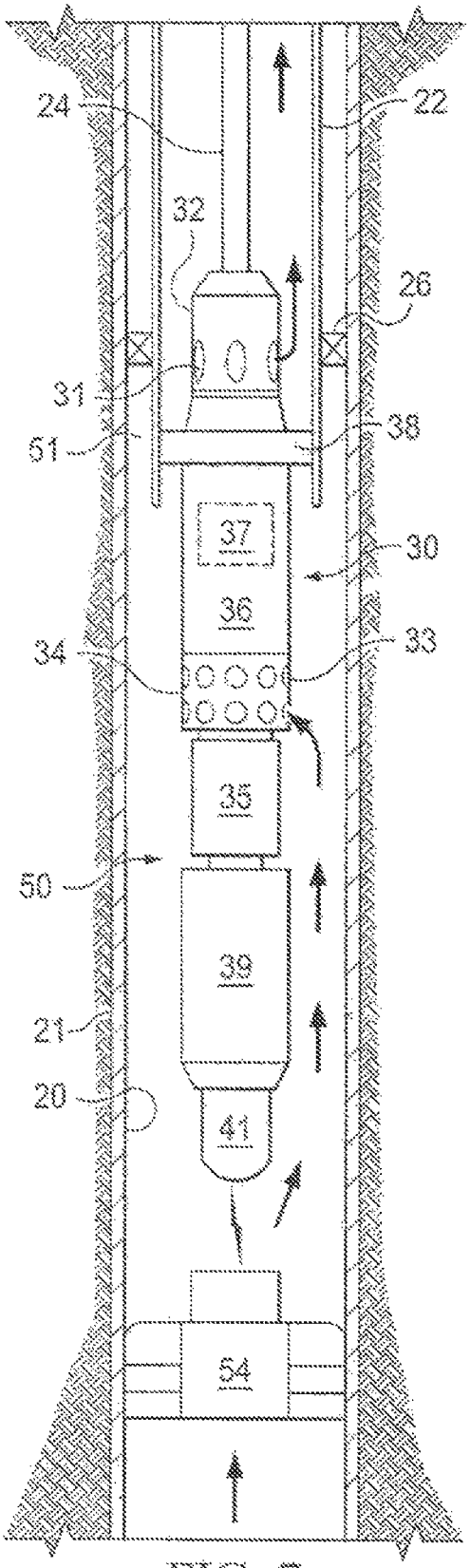
FIG. 7 is an enlarged front elevational view of an apparatus for enhancing well control in slim well completions according to yet another embodiment of the present invention.

As illustrated in FIG. 7, in alternative to the electric wet connection cable 52, an embodiment of the present invention can include, for example, an inductive coupler 41 to wirelessly communicate and provide electromagnetic power to the subsurface prevention valve 54. The inductive coupler 41, as will be understood by those skilled in the art, is connected to a distal end portion the motor 39 and extends down hole a distance from the subsurface prevention valve 54. An embodiment of the present invention can also include the use of the inductive coupler 41 in addition to the electric wet connection cable 52. According to this embodiment, either the electric wet connection cable 52 or the inductive coupler 41 can be the primary mode of power and communication transmission, and the other can be a secondary or fall-back mode. Moreover, as will be understood by those skilled in the art, embodiments of the present invention can include communicating by hydraulic or pneumatic methods as well.

In addition or in the alternative to the subsurface prevention valve 54, an embodiment of the present invention can include, for example, an electric inflow control valve 80 to control the flow of hydrocarbons that enter the interstitial space 50 between the outer surfaces of the portion of the ESP disposed outwardly from the production tubing 22 within the casing and the inner walls of the casing 20. As illustrated in FIG. 5, the electric inflow control valve 80 is positioned and connected to the inner walls of the casing 20 distal from the ESP 30. As will be understood by those skilled in the art, and illustrated in FIG. 6, this arrangement and positioning of the electric inflow control valve 80 distal from the ESP provides a greater interstitial space 50 between the outer surfaces of the ESP and the inner surfaces of the casing in a location where hydrocarbons are pumped therefrom. As will be understood by those skilled in the art, this can assist in reducing the risk of erosion damage to the ESP 30 and friction loss of the hydrocarbons produced from the producing formation 60 and can increase production rates of the slim completion.

Figure 8:
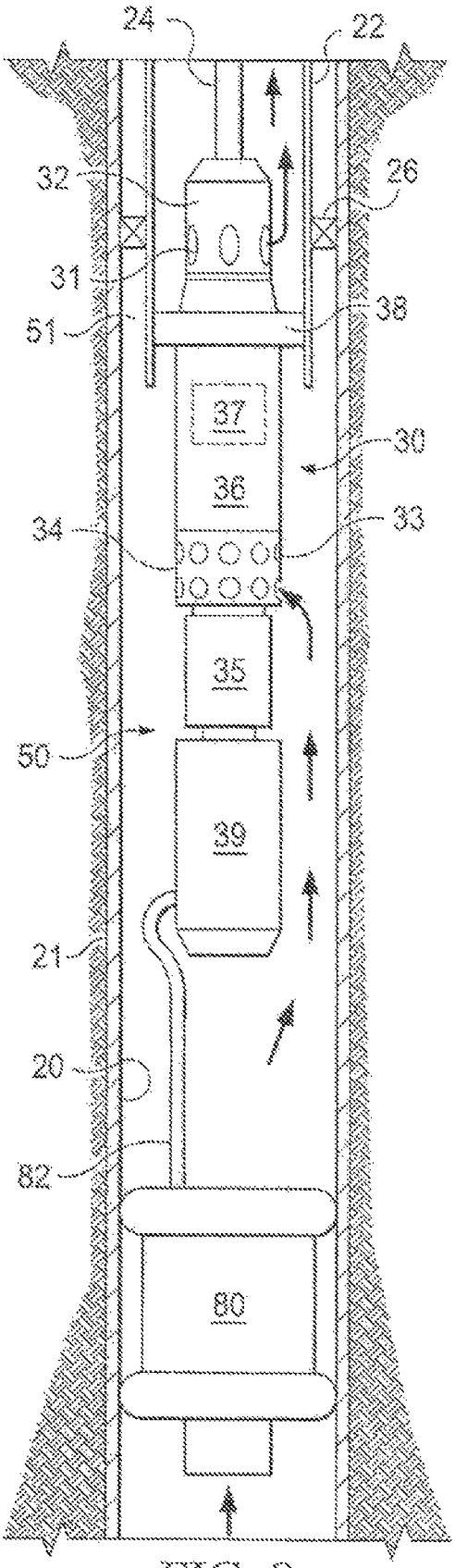
FIG. 8 is an enlarged front elevational view of an apparatus for slim well completions according to an embodiment of the present invention.

As illustrated in FIG. 5, according to an embodiment of the present invention, an electronic extension 42 can be connected to a distal end of the motor 39 to provide electromagnetic power and wireless communication to the electric inflow control valve 80. The electric inflow control valve 80 as will be understood by those skilled in the art receives power from the ESP 30 through the electric cable 24. The electric inflow control valve 80 is positioned distally from the electronic extension 42 a predetermined distance to control the amount of hydrocarbons that enter the interstitial space 50 between the outer surfaces of the ESP positioned outwardly from the production tubing 22 and the inner surfaces of the casing 20. As illustrated in FIG. 8, in the alternative or in addition to the electronic extension 42, an embodiment of the present invention can include an electronic wet connection cable 82 to provide power and communication to the electric inflow control valve 80. The electronic wet connection cable 82, according to this embodiment, can be a primary or secondary mode of communication and power.

Embodiments of the present invention also include methods of enhanced well control in shin completions. Embodiments of the method can include providing or operating any of the apparatus embodiments according to the present invention. For example, an embodiment of a method can includes positioning casing 20 into a slim bore of a hydrocarbon well 10 to support the bore of the well 10. The method includes positioning production tubing 22 only partially within the casing 20 to provide a pathway for hydrocarbons dispersed from the well 10, and to further support the slim bore of the well 10. The method can also include, for example, connecting the subsurface prevention valve 54 to inner walls of the casing 20. The subsurface prevention valve 54 being operable to prevention hydrocarbons from flowing to the surface. The method, according to embodiments of the present invention, includes positioning an ESP 30 within the casing 20 through the production tubing 22. The ESP 30 for example, can be deployed with an electric cable 24 connected to a proximal end of the ESP 30.

The positioning of the ESP 30, according to an embodiment of the method of enhanced well control, is so that at least a portion of the ESP extends outwardly from the production tubing 22 within the casing 20. The ESP 30 includes a motor 39 for driving the ESP 30, and a seal section to prevent hydrocarbons from entering within inner surfaces of the motor. According to the embodiment of the method of enhanced well control, the ESP can also include providing a pump intake 34 in a location down hole where hydrocarbons enter the ESP 30 and a pump discharge 32 in a location down hole where hydrocarbons are discharged from the ESP 30. The method can further provide, for example, the ESP 30 to include a medial pump body portion 36 extending between the pump intake 34 and the pump discharge 32.

According to an embodiment of the present invention, the positioning of the ESP 30 can be, for example, so that portion of the ESP that extends outwardly from the production tubing 22 within the casing 20 includes the motor 39, seal section 35, pump intake 34, and at least a region of the medial pump body portion 36. In the alternative, according to another embodiment of the present invention, for example, the entire medial pump body 36 can extend outwardly from the production tubing 22.

An embodiment of the method still farther can include the step of providing production tubing 22 that has an outer diameter D3 larger than the outer diameter of the ESP 30. The positioning and arrangement of the production tubing 22 provides, for example, a greater interstitial space 50 between outer surfaces of the ESP 30 and the inner surfaces of the casing 20 in a location where hydrocarbons are pumped therefrom. As will be understood by those skilled in the art, the method also includes the step of directing hydrocarbons into the interstitial space 50 between outer surfaces at the ESP and the inner surfaces of the casing 20. The method further includes operating the ESP 30 so that hydrocarbons from the interstitial space 50 between outer surfaces of the ESP disposed outside the production tubing within the casing 20 and the inner walls of the casing 20 enter and flow through the ESP 30. The operating step, according to an embodiment of the present invention, can be so that hydrocarbons are suctioned through the plurality of slat intakes 33 of the pump intake 34, flow between the medial body pump portion 36 and discharged through the plurality of discharge slots 31 to a proximal region within the inner walls of the production tubing 22.

An embodiment of a method to enhance well control in slim completion includes the step of positioning at least a portion of the production tubing so that it extends distal from a packer 26 to provide an auxiliary interstitial space or auxiliary interstitial space 51 between the outer walls of the production tubing 22 and the inner walls of the casing 20 distal from the packer 26 (e.g. positioning a packer between the outside diameter of the production tubing D3 and the inside diameter of the casing D2). This embodiment can also include the step of operating the ESP 30 so that hydrocarbons are pumped from the auxiliary interstitial space 51 by the ESP 30.

Embodiments of the present invention yet further can include transferring power to a subsurface prevention valve 54 to direct hydrocarbons into the interstitial space 50 between outer surfaces of the portion of the ESP disposed outside the production tubing 22 and the inner walls of the casing 20. The power can be transferred, for example, with an electric wet connection cable 52 connected to a distal end portion of the ESP 30 to the subsurface prevention valve 54. In the alternative or in addition to the electric wet connection cable 52, according to another embodiment of the method of providing enhanced well control, the method can include providing an inductive coupler 41 connected to a distal end portion of the ESP 30 to provide electromagnetic power and wireless communication to the subsurface prevention valve 54. This embodiment of the present invention further includes the step of transferring electromagnetic power and wireless communication with the inductively coupler 41 to the subsurface prevention valve 54.

Yet another embodiment of a method of enhanced well control in slim completion includes the step of transferring power to an electric inflow control valve 80 to control the flow of hydrocarbons directed into the interstitial space 50 between outer surfaces of the portion of the ESP 30 disposed outside the production tubing 22 within the casing 20 and the inner surfaces of the casing 20. The power can be transferred, as will be understood by those skilled in the art, for example, by an electronic extension 42 connected to a distal end portion of the ESP 30. The electronic extension 42 can provide, for example, electromagnetic power and wireless communication to the electric inflow control valve 80. In the alternative or addition to the electronic extension 42, an embodiment of the method can include providing an electronic wet connection cable 52 connected to a distal end portion of the ESP 30 to provide power and communication to the electric inflow control valve 80. This embodiment of the present invention further includes the step of transferring electromagnetic power and wireless communication with the electric inflow control valve 80.

Many modifications and other embodiments of the invention will come to the mind of one skilled in the art having the benefit of the teachings presented in the foregoing descriptions and the associated drawings. Therefore, it is to be understood that the invention is not to be limited to the illustrated embodiments disclosed, and that modifications and other embodiments are intended to be included within the scope of the appended claims.

What is claimed is:

1. A system to enhance well control in slim completions in an oil well, the system comprising:

production tubing extending at partially into the well;

an electric submersible pump (ESP) assembly disposed at an end of the production tubing, the ESP assembly comprising:

a medial pump body portion having pump intake apertures in side surfaces thereof at a lower end, and pump discharge apertures uphole of an upper end, so that when the ESP assembly is in position in the well the pump intake apertures are positioned below and outside the production tubing, and the discharge apertures are positioned within the production tubing; and a pump motor attached to and positioned below the medial pump body portion;

a packer sealingly engaged with the casing and the production tubing and sealing the space therebetween, the packer located uphole of the medial pump body portion;

an electric prevention valve positioned in the well below and spaced apart from and free of direct fluid communication with the ESP assembly and spaced below and mechanically separate from the production tubing for selectively allowing a flow of fluids from below the prevention valve to an interstitial space between outer surfaces of the ESP assembly and an inner wall of the well when the prevention valve is in an open position and preventing the flow of fluids from below the prevention valve to the interstitial space when the prevention valve is in the closed position;

an electric cable connected to the ESP assembly operable to deploy the ESP assembly and to provide a power transmission pathway to transmit power to the ESP assembly; and an electric wet connection cable extending between a distal end of the ESP assembly and a proximal end of the prevention valve operable to provide power to the prevention valve from the electric cable through the ESP assembly; wherein the medial pump body portion and the pump motor have a maximum outer dimension that is less than an inner diameter of the production tubing; and the interstitial space is an isolatable space defined by the inner wall of the well, the outer surfaces of the ESP assembly, the packer, and the prevention valve so that when the prevention valve is in the closed position, the ESP is isolated from fluids within the well that are outside of the production tubing uphole of the packer and from the flow of fluids from below the prevention valve.

2. The system of claim 1, further comprising:

an inductive coupler attached to the pump motor capable of wirelessly providing power to and communicating with the prevention valve; where the provision of both the connection cable and the inductive coupler providing redundancy to the system.

3. The system of claim 1, wherein the ESP assembly is a variable speed ESP controlled by a switchboard at the surface of the well.

4. The system of claim 1, wherein the ESP assembly further comprises:

a sealed section connecting the medial pump body portion and the pump motor, the sealed section preventing well fluids from entering the pump motor.

5. The system of claim 1, wherein the slim bore has an inside diameter in the range of two to seven inches.

6. A system to enhance well control in slim completions in an oil well, the system comprising:

casing positioned to support a slim bore of the well;

production tubing connected to and positioned at least partially within the casing;

a packer sealingly engaged with the casing and the production tubing and sealing the space therebetween; and an electric submersible pump (ESP) assembly disposed at an end of the production tubing, the ESP assembly comprising:

a medial pump body portion having pump intake apertures in side surfaces thereof at a lower end, and pump discharge apertures uphole of an upper end, so that when the ESP assembly is in position in the well the pump intake apertures are positioned below and outside the production tubing, the discharge apertures are positioned within the production tubing, and the packer is located uphole of the medial pump body portion; and a pump motor attached to and positioned below the medial pump body portion;

an electric prevention valve positioned in the well below and spaced apart from and free of direct fluid communication with the ESP assembly and spaced below and mechanically separate from the production tubing and sealingly engaging the casing for selectively allowing a flow of fluids from below the prevention valve to an interstitial space between outer surfaces of the ESP assembly and an inner wall of the well when the prevention valve is in an open position and preventing the flow of fluids from below the prevention valve to the interstitial space when the prevention valve is in the closed position; and an electric cable connected to the ESP assembly operable to deploy the ESP assembly and to provide a power transmission pathway to transmit power to the ESP assembly; and an electric wet connection cable extending between a distal end of the ESP assembly and a proximal end of the prevention valve operable to provide power to the prevention valve from the electric cable through the ESP assembly; wherein the medial pump body portion and the pump motor have a maximum outer dimension that is less than an inner diameter of the production tubing; and the interstitial space is an isolatable space defined by the inner wall of the well, the outer surfaces of the ESP assembly, the packer, and the prevention valve so that when the prevention valve is in the closed position, the ESP is isolated from fluids within the well that are outside of the production tubing uphole of the packer and from the flow of fluids from below the prevention valve.

7. The system of claim 6, further comprising:

a connection cable attached to the pump motor and the prevention valve to provide power to and communication with the prevention valve.

8. The system of claim 6, further comprising:

an inductive coupler attached to the pump motor capable of wirelessly providing power to and communicating with the prevention valve; where the provision of both the connection cable and the inductive coupler providing redundancy to the system.

9. The system of claim 6, wherein the ESP assembly is a variable speed ESP controlled by a switchboard at the surface of the well.

10. The system of claim 6, wherein the ESP assembly further comprises:

a sealed section connecting the medial pump body portion and the pump motor, the sealed section preventing well fluids from entering the pump motor.

11. A method of enhanced well control in slim completions, the method comprising:

casing the slim bore of a well;

inserting production tubing within the casing to provide a pathway for fluid dispersed from the well;

sealing the space between the casing the production tubing with a packer;

deploying an electric submersible pump (ESP) assembly into the production tubing with an electric cable, the ESP assembly comprising:

a medial pump body portion having pump intake apertures in side surfaces thereof at a lower end, and pump discharge apertures uphole of an upper end, so that when the ESP assembly is in position in the well the pump intake apertures are positioned below and outside the production tubing, the discharge apertures are positioned within the production tubing, and the packer is located uphole of the medial pump body portion; and a pump motor attached to and positioned below the medial pump body portion;

directing fluid in the well into the interstitial space between the intake apertures of the medial pump body portion and the casing, wherein the medial pump body portion and the pump motor have a maximum outer dimension that is less than an inner diameter of the production tubing;

transmitting power to the ESP assembly with the electric cable;

providing power to an electric prevention valve from the electric cable through the ESP assembly with an electric wet connection cable extending between a distal end of the ESP assembly and a proximal end of the prevention valve, the prevention valve being positioned in the well below and spaced apart from and free of direct fluid communication with the ESP assembly and spaced below and mechanically separate from the production tubing and sealingly engaging the casing;

allowing a flow of fluids from below the prevention valve to an interstitial space between outer surfaces of the ESP assembly and an inner wall of the well a prevention valve when the prevention valve is in an open position;

operating the ESP assembly to pull fluids from the interstitial space into the intake apertures of the medial pump body portion and expel the fluids out of the discharge apertures into the production tubing; and controlling the fluid flow into the ESP assembly by isolating the interstitial space from fluids within the well that are outside of the production tubing uphole of the packer and from the flow of fluids from below the prevention valve with the privation valve in the closed position, where the interstitial space is defined by the inner wall of the well, the outer surfaces of the ESP assembly, the packer, and the prevention valve.

12. The method of claim 11, further comprising:

controlling the prevention valve using an inductive coupler attached to the pump motor for wirelessly communicating with the prevention valve.

13. The method of claim 11, further comprising:

controlling the ESP assembly using a switchboard at the surface of the well.

* * * * *